United States Patent [19]

Walkden

[11] 3,979,268

[45] Sept. 7, 1976

[54] METHOD AND APPARATUS FOR REMOVING IMPURITIES FROM LIQUID METALS

[75] Inventor: Anthony John Walkden, Carpenders Park, England

[73] Assignee: The General Electric Company Limited, London, England

[22] Filed: May 28, 1975

[21] Appl. No.: 581,487

[30] Foreign Application Priority Data

June 6, 1974 United Kingdom ..... 25147/74

[52] U.S. Cl. ..... 204/140; 204/275

[51] Int. Cl.[2] ..... C25C 3/00

[58] Field of Search ..... 204/140, 141.5, 273, 204/275, 237

[56] References Cited

UNITED STATES PATENTS

| | | | |
|---|---|---|---|
| 2,067,361 | 1/1937 | Vivian | 204/140 |
| 3,335,076 | 8/1967 | Burkhardt | 204/140 |
| 3,364,128 | 1/1968 | Williston et al. | 204/140 |

FOREIGN PATENTS OR APPLICATIONS

| | | | |
|---|---|---|---|
| 1,317,478 | 5/1973 | United Kingdom | 204/140 |

*Primary Examiner*—T. M. Tufariello

*Attorney, Agent, or Firm*—Kirschstein, Kirschstein, Ottinger & Frank

[57] ABSTRACT

A method for removing an impurity from a liquid metal in which: a flow of the liquid metal containing the impurity is passed into a chamber containing a quantity of the liquid metal and an electrolyte in which the impurity dissociates to form positive and negative ions; a voltage is applied between a pair of electrodes disposed respectively in the electrolyte and liquid metal to effect electrolytic extraction of the ions from the electrolyte; a flow of liquid metal is extracted from the chamber for circulation through an associated equipment; and an appreciable quantity of the electrolyte is circulated with the extracted liquid metal.

15 Claims, 4 Drawing Figures

METHOD AND APPARATUS FOR REMOVING IMPURITIES FROM LIQUID METALS

Figure 1:
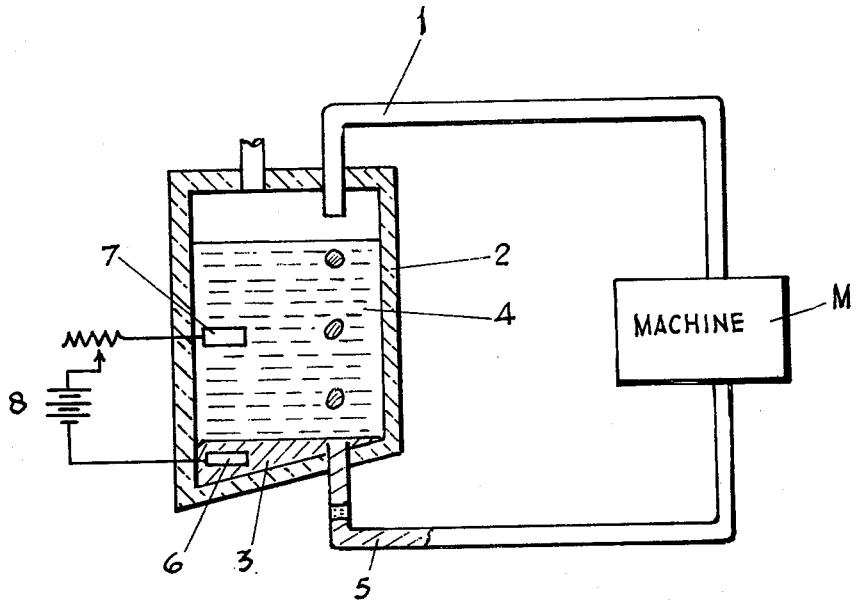

This invention relates to methods and apparatus for removing impurities from liquid metals.

The invention relates particularly to such a method and apparatus of the kind wherein a flow of a liquid metal containing an impurity is passed into a chamber containing a quantity of said liquid metal and a quantity of liquid electrolyte in which electrolyte the impurity dissociates to form positive and negative ions, said electrolyte floating on said liquid metal or vice versa depending on their relative densities; a voltage is applied between a pair of electrodes disposed respectively in said electrolyte and liquid metal to effect electrolytic extraction of said ions from said electrolyte; and a flow of said liquid metal is extracted from said liquid metal in said chamber for supply to an associated equipment. Such a method and apparatus are described in United Kingdom Patent Specification No. 1,317,478.

Such a method and apparatus find especial application with various kinds of equipment which utilise liquid metal, the liquid metal being circulated through the equipment via apparatus for carrying out the method to remove one or more impurities with which the liquid metal has become contaminated during its passage through the equipment. One example of such an equipment is a liquid metal slip-ring arrangement in an electric machine. Another example is a liquid metal seal arrangement for a rotatable shaft.

It is an object of the present invention to provide improved method and apparatus of the kind specified for use in such an application.

According to one aspect of the present invention in a method of the kind specified an appreciable quantity of said electrolyte is supplied to the associated equipment with the extracted liquid metal.

Typically the volume of said electrolyte supplied to the associated equipment is one tenth or more of the volume of extracted liquid metal supplied to said equipment.

Said electrolyte supplied to the associated equipment with the extracted liquid metal is conveniently derived from said chamber.

The invention lies in the discovery that the circulation of an appreciable quantity of the electrolyte through an equipment utilising the liquid metal serves to prevent the build-up of deposits of the impurity in the equipment, without adversely affecting the operation of the equipment.

In one particular method in accordance with the invention the flow of liquid metal entering the chamber disturbs the interface between the liquid metal and electrolyte in the chamber, thereby occluding a quantity of the electrolyte within the liquid metal extracted from said chamber.

In another particular method in accordance with the invention the interface between the liquid metal and electrolyte in the chamber is disturbed by means of a paddle, thereby occluding a quantity of said electrolyte within the liquid metal extracted from said chamber.

In a further particular method in accordance with the invention a quantity of said electrolyte is extracted from said chamber separately from the liquid metal for supply to said associated equipment with the extracted liquid metal.

In yet a further particular method in accordance with the invention the interface between the liquid metal and electrolyte in the chamber is disturbed by the flow of liquid metal extracted from said chamber, thereby occluding a quantity of said electrolyte within the liquid metal extracted from said chamber.

According to a second aspect of the invention there is provided an apparatus for use in removing an impurity from a liquid metal comprising: a chamber containing a quantity of said liquid metal and a quantity of a liquid electrolyte in which electrolyte the impurity will dissociate to form positive and negative ions, said electrolyte floating on said liquid metal or vice versa depending on their relative densities; a pair of electrodes disposed respectively in said electrolyte and liquid metal; means for applying a voltage between the electrodes to effect electrolytic extraction of said ions from said electrolyte; an inlet for passing a flow of said liquid metal containing the impurity into said chamber; and an outlet for extracting a flow of said liquid metal from said liquid metal in said chamber for supply to an associated equipment; the apparatus being arranged so that in operation an appreciable quantity of said electrolyte is supplied to said associated equipment with the extracted liquid metal.

In one particular apparatus in accordance with the invention said inlet of the apparatus is positioned so that the flow of liquid metal entering the chamber disturbs the interface between the liquid metal and electrolyte in the chamber at a region adjacent said outlet of the apparatus, thereby to occlude a quantity of the electrolyte within the liquid metal extracted via said outlet.

In another particular apparatus in accordance with the invention said apparatus includes a paddle arranged to disturb the interface between the liquid metal and electrolyte in the chamber at a region adjacent said outlet, thereby to occlude a quantity of said electrolyte within the liquid metal extracted via said outlet.

In a further particular apparatus in accordance with the invention the chamber is provided with a second outlet for extracting said electrolyte supplied to the associated equipment from said chamber separately from said extracted liquid metal.

In yet a further particular apparatus in accordance with the invention said outlet is positioned adjacent the interface between the liquid metal and electrolyte in the chamber so that the flow of extracted liquid metal through said outlet disturbs said interface and thereby occludes a quantity of said electrolyte within the liquid metal extracted via said outlet. In such an arrangement a pulsating pump is preferably provided between said outlet and said associated equipment.

Four methods and apparatuses in accordance with the invention will now be described, by way of example, with reference to the accompanying drawings in which FIGS. 1, 2, 3 and 4 are respectively diagrams of the four apparatuses.

The apparatuses are intended for use in circulating a supply of a gallium/indium alloy through a liquid metal slip-ring arrangement of an electrical machine.

Referring to FIG. 1, in the first apparatus to be described the alloy is passed from the machine M via tubing 1 to a chamber 2 whose walls are formed of electrically insulating material.

The bottom of the chamber 2 contains a quantity of the alloy 3 on the upper surface of which there floats a quantity of sodium hydroxide solution 4, the chamber 2 having a sloping base so that the liquid metal 3 is relatively shallow at one side of the chamber 2.

The end of the tubing 1 within the chamber 2 is disposed above the upper surface of the sodium hydroxide solution 4, at the side of the chamber 2 where the liquid metal 3 is shallower.

The lower end of the chamber 2 is connected to the inlet of the liquid metal circuit of the machine via tubing 5, the end of the tubing 5 within the chamber 2 lying vertically below the end of the tubing 1, and just below the surface of the alloy 3.

The chamber 2 also houses two electrodes 6 and 7 disposed respectively in the alloy 3 and the solution 4, the electrodes 6 and 7 being respectively connected to the negative and positive terminals of a d.c. electric supply 8.

In operation the alloy is contaminated during its passage through the machine by oxygen and water vapour to form gallium oxide and gallium hydroxide. When the contaminated alloy enters the chamber 2, it falls from the end of the tubing 1 in a succession of droplets, some of the gallium oxide and hydroxide dissolving in the solution 4 and the remainder floating on the surface of the alloy 3.

The oxide and hydroxide floating on the surface of the alloy 3 gradually disappear with the formation of gallium, water and hydrogen; some or all of the following reactions occur.

$$Ga(OH)_3 \rightleftharpoons Ga^{3+} + 3\,OH^-$$

$$Ga^{3+} + 3\,e^- \rightarrow Ga\downarrow$$

$$H_3O^+ + e^- \rightarrow [H] + H_2O$$

$$\tfrac{1}{2}\,Ga_2O_3 + 3\,[H] \rightarrow Ga\downarrow + 3/2\,H_2O$$

$$Ga(OH)_3 + 3\,[H] \leftrightarrow Ga\downarrow + 3\,H_2O$$

With regard to the dissolved gallium oxide and hydroxide, since the oxide and hydroxide of gallium are amphoteric they dissolve in the solution 4 to form negative gallate ions, such as $[Ga(OH)_4]^-$, by the following reactions:

$$\tfrac{1}{2}\,Ga_2O_3 + 3/2\,H_2O \rightarrow Ga(OH)_3$$

$$Ga(OH)_3 \rightleftharpoons Ga^{3+} + 3\,OH^-$$

$$Ga^{3+} + 4\,OH^- \rightarrow [Ga(OH)_4]^-$$

The gallate ions diffuse to the surface of the alloy 3, against the potential gradient existing due to the voltage applied between electrodes 6 and 7, where gallium is deposited by the following reaction:

$$[Ga(OH)_4]^- + 3e^- \rightarrow Ga\downarrow + 4\,OH^-$$

At the electrode 6 the primary action is the discharge of the negative hydroxyl ions, as follows:

$$2\,OH^- \rightarrow H_2O + \tfrac{1}{2}\,O_2\uparrow + 2e^-$$

However, the potential gradient will drive some of the gallate ions to the electrode 6 where the following reaction is thought to then occur:

$$[Ga(OH)_4]^- \rightarrow Ga(OH)_3 + 1/2\,H_2O + 1/4\,O_2\uparrow + e^-$$

The gallium hydroxide so formed then re-dissolves; thus the gallate merely transports hydroxyl ions to the electrode 6 with no deposition of metal or oxide.

Thus the contaminants are removed from the alloy and the solution 4 does not become saturated with the contaminants. The current consumed by the apparatus is found to increase with the quantity of contaminants entering the apparatus, so it appears that equilibrium is attained.

As mentioned above, on entering the chamber 2 via the tubing 1 alloy from the machine falls under the action of gravity in a succession of droplets. On reaching the surface of the alloy the droplets disturb the interface between the alloy 3 and the solution 4. Due to the close proximity of the end of the tubing 5 to the interface, an appreciable quantity of solution is occluded within the alloy circulated through the machine via the tubing 5.

The passage of solution through the liquid metal circuit of the machine is found to prevent the build up of gallium oxide and gallium hydroxide deposits in the machine, the solution acting as a solvent for these deposits and carrying them back to the chamber 2 for electrolytic extraction.

In a typical slip-ring arrangement the circulated alloy and solution are subject to centrifugal forces such that the solution takes up a position radially inwards of the alloy due to the lower density of the solution. The solution is thus at a suitable position to wash away the tidemark of oxides which tends to form at the edges of the alloy.

With such an arrangement it is found that the use of a blanket gas at the slip-rings to inhibit the formation of oxides can be dispensed with.

It will be appreciated that the ducts in the machine along which the alloy and solution pass in operation, and particularly the exits from the slip-rings, must be designed so that a free flow of both alloy and solution will take place despite any difference which may occur in the positions of the solution and alloy in a duct due to their different densities.

Most satisfactory operation has been obtained in practice with the solution circulated through the machine having one tenth or more of the volume of the liquid metal circulated, but of course the proportion of solution must not be so high that the electrical performance of the slip-ring is adversely affected.

Figure 2:
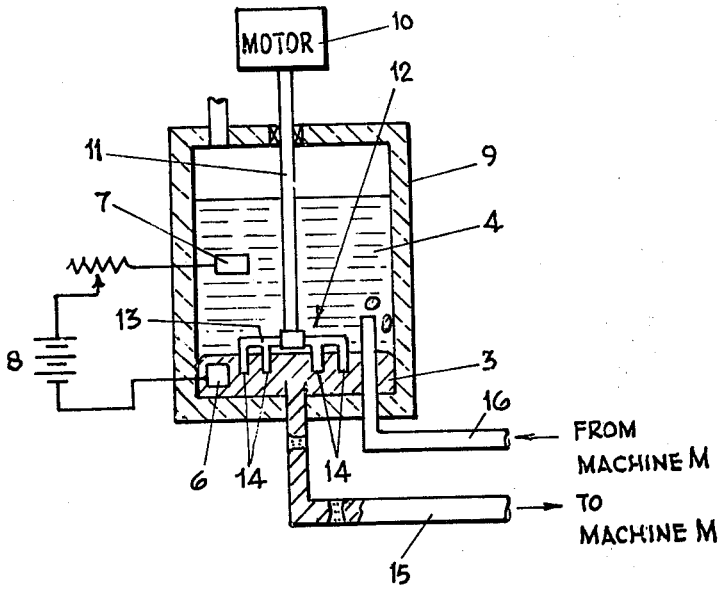

Referring now to FIG. 2, in the second arrangement to be described a chamber 9 having a flat base is used so that the alloy 3 in the chamber 9 is of uniform depth.

Above the chamber 9 there is provided an electric motor 10 which drives a vertical shaft 11 which extends centrally through the chamber 9. A paddle 12 made of electrically insulating material, for example, a plastics material, is mounted on the shaft 11. The paddle 12 comprises two radial arms 13 arranged to rotate in a horizontal plane just above the interface between the alloy 3 and the solution 4, each arm carrying two blades 14 which extend downwardly into the alloy 3.

The lower end of the chamber 9 is connected to the inlet of the liquid metal circuit of the machine via tubing 15 whose end within the chamber 9 lies just below the paddle 12.

The outlet of the liquid metal circuit of the machine is connected to the chamber 9 via tubing 16, the tubing 16 passing through the base of the chamber 9 and having its end disposed in the solution 4 well above the alloy/solution interface. With this arrangement the pressure head required to return alloy from the machine to the chamber 9 is lower than in the arrangement of FIG. 1.

During operation of the apparatus the paddle 12 is rotated continuously thereby continuously and rapidly breaking up the surface of the alloy 3. Due to the close proximity of the end of the tubing 15 to the paddle 12 an appreciable quantity of the solution is occluded within the alloy circulated through the machine, as in the arrangement of FIG. 1.

The breaking up of the surface of the alloy 3 also serves to increase the reacting surface between the solution 4 and the alloy thereby increasing the speed and efficiency of removal of impurities.

Figure 3:
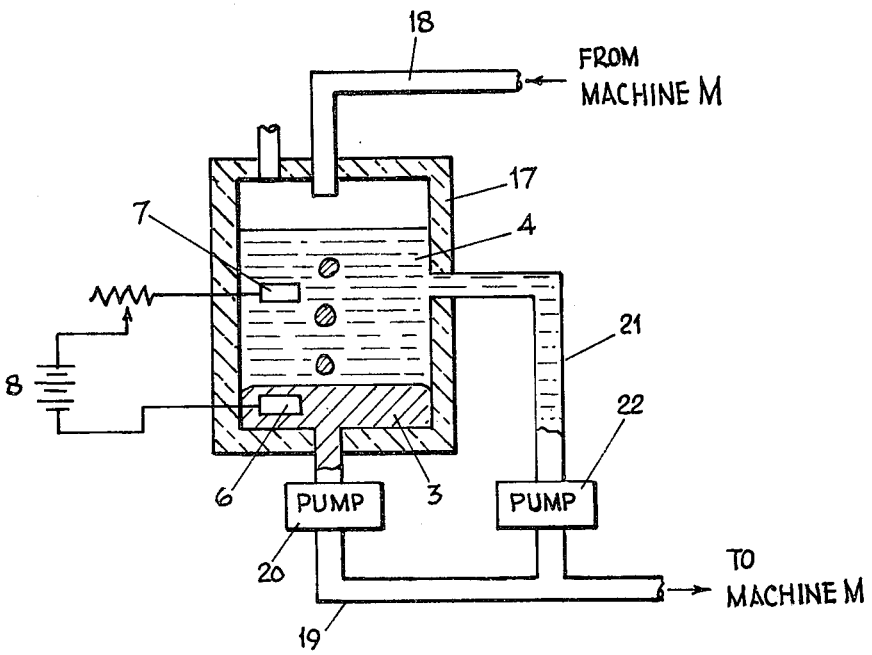

Referring now to FIG. 3, in the third arrangement to be described, a chamber 17 similar to the chamber of FIG. 2 is used, and the outlet of the liquid metal circuit of the machine is connected to the chamber via tubing 18.

Alloy from the lower end of the chamber 17 is supplied to the inlet of the liquid metal circuit of the machine via tubing 19 in which an electrically driven pump 20 is connected, and solution is supplied separately to the machine inlet from the chamber 17 via tubing 21 in which a second pump 22 is connected.

With this arrangement the quantities of alloy and solution supplied to the machine can be more accurately controlled.

Figure 4:
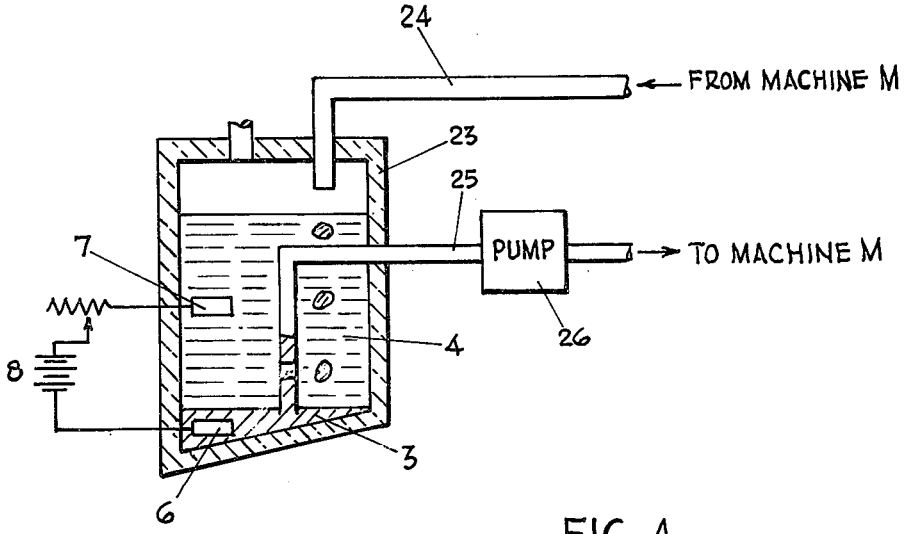

Referring now to FIG. 4, in the fourth arrangement to be described a chamber 23 similar to the chamber 2 of FIG. 1 is used and the outlet of the liquid metal circuit of the machine is connected to the chamber via tubing 24.

Alloy from the lower end of the chamber 23 is supplied to the inlet of the liquid metal circuit of the machine via tubing 25 whose end within the chamber 23 lies just below the surface of the alloy 3. From its end within the alloy 3 the tubing 25 extends first upwardly through the solution 4, and then sideways through the wall of the chamber 23 and to the machine. Between the chamber 23 and the machine a pump 26 is connected in the tubing 25. The pump 26 operates in a pulsating manner and the resulting periodic extraction of alloy from the chamber sufficiently disturbs the interface between the alloy 3 and the solution 4 in the region of the end of the tubing 25 to cause an appreciable quantity of solution to be occluded within the alloy supplied to the machine via the tubing 25.

I claim:

1. A method of removing from a liquid metal an impurity produced during circulation of the liquid metal through an equipment, the method comprising: passing a flow of liquid metal from the equipment into a chamber containing a quantity of said liquid metal and a quantity of liquid electrolyte in which electrolyte the impurity dissociates to form positive and negative ions, said electrolyte floating on said liquid metal or vice versa depending on their relative densities; applying a voltage between a pair of electrodes disposed respectively in said electrolyte and said liquid metal in said chamber; and circulating a flow of said liquid metal from said chamber through said equipment and thence back to said chamber with an appreciable quantity of said electrolyte.

2. A method according to claim 1 wherein the electrolyte circulated through the equipment has a volume at least one tenth of the volume of the liquid metal circulated through said equipment.

3. A method according to claim 1 wherein said electrolyte circulated through the equipment with the liquid metal is derived from said chamber.

4. A method according to claim 3 wherein the flow of liquid metal into the chamber from the equipment disturbs the interface between the liquid metal and electrolyte in the chamber, thereby occluding a quantity of the electrolyte within the liquid metal circulated through the equipment.

5. A method according to claim 3 wherein the interface between the liquid metal and electrolyte in the chamber is disturbed by means of a paddle, thereby occluding a quantity of said electrolyte within the liquid metal circulated through the equipment from said chamber.

6. A method according to claim 3 wherein the electrolyte circulated through the equipment is extracted from said chamber separately from the liquid metal circulated through the equipment.

7. A method according to claim 3 wherein the interface between the liquid metal and electrolyte in the chamber is disturbed by the flow of liquid metal out of said chamber to said equipment, thereby occluding a quantity of said electrolyte within the liquid metal circulated through the equipment from said chamber.

8. A method according to claim 1 wherein said impurity is an oxide or hydroxide of the liquid metal, or a component of the liquid metal and said electrolyte is an aqueous solution in which said impurity is soluble.

9. A method according to claim 8 wherein said impurity is gallium oxide or gallium hydroxide and said electrolyte is an aqueous sodium hydroxide solution.

10. An arrangement comprising an equipment through which a flow of liquid metal is circulated in operation, and an apparatus for removing an impurity produced in the liquid metal during its circulation through the equipment, the apparatus comprising: a chamber containing a quantity of said liquid metal and a quantity of a liquid electrolyte in which electrolyte the impurity will dissociate to form positive and negative ions, said electrolyte floating on said liquid metal or vice versa depending on their relative densities; a pair of electrodes disposed respectively in said electrolyte and liquid metal; means for applying a voltage between the electrodes to effect electrolytic extraction of said ions from said electrolyte; an inlet for passing a flow of said liquid metal into said chamber from said equipment; and an outlet for circulating a flow of said liquid metal from said chamber through said equipment and thence back to the chamber via said inlet with an appreciable quantity of said electrolyte.

11. An apparatus according to claim 10 wherein said inlet of the apparatus is positioned so that the flow of liquid metal entering the chamber via said inlet disturbs the interface between the liquid metal and electrolyte in the chamber at a region adjacent said outlet of the apparatus, thereby to occlude a quantity of the electrolyte within the liquid metal circulated through the equipment via said outlet.

12. An apparatus according to claim 10 including a paddle which disturbs the interface between the liquid metal and electrolyte in the chamber at a region adjacent said outlet, thereby to occlude a quantity of said electrolyte within the liquid metal circulated through the equipment via said outlet.

13. An apparatus according to claim 10 wherein the chamber is provided with a second outlet via which said electrolyte circulated through the equipment is supplied to said equipment separately from said circulated liquid metal.

14. An apparatus according to claim 10 wherein said outlet is positioned adjacent the interface between the liquid metal and electrolyte in the chamber so that the flow of liquid metal through said outlet disturbs said interface and thereby occludes a quantity of said electrolyte within the liquid metal circulated through the equipment via said outlet.

15. An apparatus according to claim 14 wherein a pulsating pump is provided between said outlet and said equipment.

* * * * *